US009701434B2

(12) United States Patent
Kuninobu

(10) Patent No.: US 9,701,434 B2
(45) Date of Patent: Jul. 11, 2017

(54) EASILY OPENABLE BOX

(71) Applicant: Kotaro Kuninobu, Hofu (JP)

(72) Inventor: Kotaro Kuninobu, Hofu (JP)

( * ) Notice: Subject to any disclaimer, the term of this patent is extended or adjusted under 35 U.S.C. 154(b) by 0 days.

(21) Appl. No.: 15/210,892

(22) Filed: Jul. 15, 2016

(65) Prior Publication Data

US 2016/0318648 A1 Nov. 3, 2016

Related U.S. Application Data

(63) Continuation of application No. PCT/JP2014/067399, filed on Jun. 30, 2014.

(30) Foreign Application Priority Data

Jan. 22, 2014 (JP) ..... 2014-009237
Jun. 14, 2014 (JP) ..... 2014-122948

(51) Int. Cl.
*B65D 5/02* (2006.01)
*B65D 5/42* (2006.01)
*B65D 5/54* (2006.01)
*B65B 51/06* (2006.01)

(52) U.S. Cl.
CPC ..... *B65D 5/0236* (2013.01); *B65B 51/067* (2013.01); *B65D 5/4212* (2013.01); *B65D 5/54* (2013.01); *B65B 51/06* (2013.01)

(58) Field of Classification Search
CPC ..... B65D 5/0236; B65D 5/54; B65D 5/4212
USPC ..... 229/125.39, 132, 136
See application file for complete search history.

(56) References Cited

U.S. PATENT DOCUMENTS 3,178,094 A * 4/1965 Ridgeway ..... B65D 5/0236 229/125.39
4,647,485 A * 3/1987 Nelson ..... C09J 7/02 206/311
5,366,775 A * 11/1994 Kao ..... C09J 7/026 428/137
5,507,429 A * 4/1996 Arlin ..... B65D 55/06 206/807
7,135,212 B2 * 11/2006 Monschein ..... B65D 5/0236 428/201

(Continued)

FOREIGN PATENT DOCUMENTS

JP S54-133165 U 3/1978
JP H01-78509 U 5/1989
JP H06-051256 U 7/1994

(Continued)

OTHER PUBLICATIONS

International Search Report for PCT/JP2014/067399 dated Oct. 7, 2014.
PCT written opinion dated Oct. 7, 2014.

*Primary Examiner* — Christopher Demeree
*Assistant Examiner* — Phillip Schmidt
(74) *Attorney, Agent, or Firm* — Yokoi & Co., U.S.A.; Toshiyuki Yokoi

(57) ABSTRACT

A box sealed by fixing a surrounding area of a mating portion of outer flaps and an end face plate by an adhesive tape made of a film as a base material. Information showing a forming position of a cut to function as a trigger to unseal the box is preliminarily indicated on the box. According to the information, the cut is formed on the adhesive tape only at a portion facing to the mating portion in a state that the outer flaps are sealed.

3 Claims, 11 Drawing Sheets

(56) References Cited

U.S. PATENT DOCUMENTS

| | | | | |
|---|---|---|---|---|
| 2001/0052382 | A1* | 12/2001 | Moulds ..... | B65D 5/0236<br>156/212 |
| 2011/0240650 | A1* | 10/2011 | Thomas ..... | B65D 5/0236<br>220/359.1 |

FOREIGN PATENT DOCUMENTS

| | | | |
|---|---|---|---|
| JP | H07-251812 | A | 10/1995 |
| JP | 2004-175451 | A | 6/2004 |
| JP | 2012-162714 | A | 8/2012 |
| JP | 5536256 | B | 5/2014 |

* cited by examiner

EASILY OPENABLE BOX

CROSS-REFERENCES TO RELATED APPLICATIONS

This Application claims the benefit of priority and is a Continuation application of the prior International Patent Application No. PCT/JP2014/067399, with an international filing date of Jun. 30, 2014, which designated the United States, and is related to the Japanese Patent Application No. 2014-009237 filed Jan. 22, 2014, and Japanese Patent Application No. 2014-122948 filed Jun. 14, 2014, the entire disclosures of all applications are expressly incorporated by reference in their entirety herein.

BACKGROUND OF THE INVENTION

1. Field of the Invention

The present invention is related to a method and a device for facilitating unsealing a box sealed by using an adhesive tape, and an easily openable box.

2. Description of Related Art

A box such as a cardboard box used for packing things is sealed by overlaying outer flaps on inner flaps using an adhesive tape. Here, the outer flaps are provided to be connected with upper and lower ends of a pair of side face plates, and the inner flaps are provided to be connected with upper and lower ends of a pair of end face plates. In general, when unsealing the box sealed by the above described method, the adhesive tape is cut by using a cutter and the like, or the adhesive tape is peeled off. In addition, the conventionally proposed methods for easily unsealing the box sealed by the adhesive tape can be roughly divided into three methods.

The first method is a method for easily peeling off the adhesive tape from the box to unseal the box. In Patent Document 1, a cut line is formed on the box to peel off the adhesive tape easily.

The second method is a method for easily unsealing the box by using an adhesive tape having a cut or a perforation to seal the box. In Patent Document 2, a cut or a hole is continuously formed on the adhesive tape in advance. In Patent Document 3, a perforation is formed on the center of the adhesive tape in advance.

The third method is a method for easily unsealing the box by forming a perforation along a mating portion after the box is sealed by the adhesive tape as shown in Patent Document 4. When unsealing the box, the perforation is used.

[Patent document 1] Japanese Unexamined Patent Application Publication No. 2004-175451

[Patent Document 2] Japanese unexamined utility model application publication No. S54-133165

[Patent Document 3] Japanese unexamined utility model application publication No. H06-051256

[Patent document 4] Japanese Unexamined Patent Application Publication No. H07-251812

BRIEF SUMMARY OF THE INVENTION

In the general method of unsealing the box by cutting the adhesive tape using a cutter, the cutter is always required. In addition, the cutter may damage the things in the box, and there is a risk of injury. In the method of peeling off the adhesive tape to unseal the box, it is not easy to peel off the adhesive tape strongly adhered to the box. Thus, labor and time are required, and there is a risk of damaging the nail when peeling off the adhesive tape.

In the method of Patent Document 1, in order to solve the problem of difficulty in peeling off the adhesive tape, the cut line is formed on the end face plates of the box at a portion near the adhesive tape or the cut line is formed on the center of a lid surface. By breaking the cut line, the adhesive tape can be easily held and peeled off. In the above described method, since the positon of the cut line formed on the box is fixed, the adhesive tape should be adhered to the correct position. Thus, the work of adhering the adhesive tape should be done carefully. In addition, an outer liner of the box is peeled off together with the adhesive tape. Thus, sealing ability is deteriorated when re-using the box.

In the method of Patent Document 2, since the cut, the hole or the perforation is continuously formed on the adhesive tape, the adhesive tape is cut when an unintentional force is applied to the adhesive tape during the work of sealing the box. In Patent Document 3, it is difficult to align the perforation with the mating portion when adhering the adhesive tape on the box. In Patent Document 4, the perforation is formed on the adhesive tape at a portion facing the mating portion of the outer flaps of the box after the box is sealed. Therefore, the adhesive tape is not cut when sealing the box and the perforation of the adhesive tape and the mating portion of the box are not misaligned. However, in Patent Documents 2, 3 and 4, the perforation is formed on the adhesive tape over the entire length of the mating portion between the outer flaps. Accordingly, when a force is applied from the above when transporting the box, the adhesive tape having the perforation is easily cut and the box may be unintentionally unsealed.

The present invention solves the problems of the prior art and provides an easily openable box without using tools although the box is hardly unsealed even when an unintentional force is applied during transportation. In addition, the present invention provides a method for facilitating unsealing the box sealed by the adhesive tape and a device and a tool for facilitating unsealing the box.

In the box targeted in the present invention, a mating portion can be formed by facing edge portions of a pair of outer flaps of the box to each other, and the box is sealed by fixing a neighboring part of the mating portion and an end face plate of the box using an adhesive tape made of a film as a base material.

In one embodiment of the present invention, in the above described sealed box, an indicator showing a forming position of a cut to function as a trigger to unseal the box is preliminarily indicated on the box, and the cut is formed on the adhesive tape only at a portion facing to or neighboring to a part of the mating portion indicated by the indicator in a state that the outer flaps are sealed.

The unsealing method of the easily openable box of the present invention is as follows.

A person who unseals the box pushes the mating portion of the sealed box by a nail tip by referring to the indicator of the box showing the forming position of the cut. Because of this, strong force is partly applied to the cut of the adhesive tape and the cut is changed into a crack. Then, when the person who unseals the box moves the nail along the mating portion while the nail is pushed down lightly, the crack is extended along the direction of the mating portion and the adhesive tape between the outer flaps is cut. Then, when the finger is inserted from the mating portion between the outer flaps to lift up one of the outer flaps, the crack is further extended along the edge portion of the outer flap which is lifted up, and the adhesive tape connecting the outer flaps with the end face plate is cut. Finally, when the other of the outer flaps is lifted up, the adhesive tape between the other of outer flaps and the end face plate is cut. Thus, the box can be unsealed.

The present invention uses a tearable property of the film made of synthetic resin or the like. Such film made of synthetic resin or the like is easily torn when the cut is formed. Even when the cut is small, such as a crack formed by piercing with a needle, the cut is deformed and changed into a crack when the strong force is partly applied by the nail tip. The crack has a property of being easily extended by a small force. Because of this, the sealed box can be easily unsealed only by the nail tip.

Even when the force is applied on the cut at a portion adhered to the outer flaps or other portions of the box, the cut is not deformed and not changed into a crack. Thus, the cut does not function as a trigger to unseal the box at this portion. Accordingly, "cut to function as a trigger to unseal the box" means the cut formed on the adhesive tape at a portion facing to or neighboring to the mating portion. Note that the cut neighboring to the mating portion can be a trigger to unseal the box because the cut is deformed when the strong force is partly applied to the mating portion and the adhesive tape neighboring to the mating portion is stretched and peeled off.

Even when an unintentional force is applied during transportation, for example, the unintentional force is applied entirely on the surface in many cases. Thus, there is little possibility that the strong force is applied to cause the crack on the cut formed on only a part of the surface.

When the cut is formed on the adhesive tape facing the mating portion near the end face plates, there is less possibility that the box is unsealed by the unintentional force during transportation. Although the mating portion becomes wider around the center when the center of the upper surface of the box is pushed and the outer flaps are pushed down, the mating portion becomes narrower around the end face plates on the contrary. Thus, the strong force is not applied to the cut around the end face plates and the cut is not changed into a crack by the pushed force applied to the box from the above. In addition, even when the edge of the box is pushed, the force is distributed by the end face plates and the inner flaps. Thus, the strong force is not applied to the cut.

In the prior art, the perforation is formed entirely on the mating portion and therefore the sealing ability is inferior to the present invention.

In another embodiment of the present invention, in the above described box, a clearance is formed on the mating portion by preliminarily cutting partly the edge portions (mating portion) of at least one of the outer flaps, a width of the clearance is within 1 mm to 5 mm, a length of the clearance is within 5 mm to 20 mm, the width being measured orthogonal to a longitudinal direction of the mating portion, the length being measured along the longitudinal direction of the mating portion, and a cut to function as a trigger to unseal the box is formed on the adhesive tape at a portion facing the clearance.

In some boxes and some sealing methods, the edge portions of the outer flaps facing to each other may be in tight contact with each other and the mating portion may have a linear shape. In such a situation, it is difficult to certainty form the cut on the mating portion to function as a trigger to unseal the box.

In the present invention, the edge of the mating portion of the outer flaps are preliminarily cut to form the clearance at the mating portion when the outer flaps are sealed. Because of this, the present invention can provide the box enabling to form the cut to function as a trigger to unseal the box certainty on the adhesive tape.

In another embodiment of the present invention, in the above described box, at least one of the outer flaps is preliminarily cut partly at the edge portions of the mating portion side of the outer flaps so that a clearance is formed on the mating portion at a range within 30 mm from an edge of the end face plate side of the outer flaps in a state that the outer flaps are sealed, a width of the clearance is within 5 mm to 25 mm and a length of the clearance is equal to or less than two thirds (⅔) of a short-side length of the adhesive tape, the width being measured orthogonal to a longitudinal direction of the mating portion, and a cut to function as a trigger to unseal the box is formed on the adhesive tape at a portion facing to the clearance.

In the above described box, larger number of cuts can be formed on the adhesive tape at a portion facing to the clearance near the end face plates when compared to the box without having the clearance.

When the other of the outer flaps is lifted up to unseal the box, the adhesive tape located at the portion of the clearance is pulled and the force is applied to the not used cut located at this portion. Thus, a crack is newly formed and the adhesive tape between the other of outer flaps and the end face plate is cut. Thus, the box can be easily unsealed.

In another embodiment of the present invention, in the above described box, a perforation or a slit orthogonal to or oblique to the longitudinal direction of the mating portion is formed on at least one of the outer flaps, the slit having a width of 5 mm or less, the perforation or the slit is formed at a range within 40 mm in a longitudinal direction of the mating portion, the perforation or the slit is formed at a range within 25 mm in a direction orthogonal to the longitudinal direction, the perforation or the slit is formed at a range within equal to or less than two thirds (⅔) of a short-side length of the adhesive tape, a part of the outer flaps is pushed inside the box when the perforation or the slit is pushed, and a cut to function as a trigger to unseal the box is formed on the adhesive tape at a portion facing the perforation or the slit and a surrounding area of the perforation or the slit.

As the unsealing method of the above described box, when a portion surrounded by the perforation or the slit formed on the box is pushed by a nail or a finger, a part of the outer flaps is pushed inside the box by the break of the perforation or the slit. At that time, the force to be pushed is also applied to the adhesive tape. Thus, the cut is changed into a crack orthogonal to or oblique to the mating portion.

Then, the adhesive tape between the outer flaps is cut by using the cut facing the mating portion. When the finger is inserted from the mating portion to lift up one of the outer flaps, the crack formed on the mating portion is extended, and further extended by being connected with the crack orthogonal to or oblique to the mating portion. Thus, the adhesive tape between one of the outer flaps and the end face plate is cut. After that, when the other of the outer flaps is lifted up, the crack is extended and the adhesive tape between the other of outer flaps and the end face plate is cut. Thus, the box can be unsealed.

In another embodiment of the present invention, a method for facilitating unsealing the box sealed by the above procedure is provided, the method comprising the step of: moving a device or a tool for forming the cut on the adhesive tape or moving the box in a direction approximately orthogonal to a longitudinal direction of the mating portion to form a cut on the adhesive tape only at an arbitrarily portion of the adhesive tape.

In the present invention, the cut is partly formed on the adhesive tape used for sealing the box only at a portion facing to the mating portion. Because of this, the box can be easily unsealed although there is little possibility that the box is unsealed by an unintentional force.

Another embodiment of the present invention is a tool for forming the cut for facilitating unsealing the box sealed by the above procedure. The tool is comprised of: a roller having a protrusion on a cylindrical surface to form a cut on the adhesive tape; and a guide that makes the roller pass thorough the adhesive tape at a portion and facing a part of the mating portion between the outer flaps and make the roller rotate in a direction approximately orthogonal to a longitudinal direction of the mating portion, the part being located at an arbitrary distance from the end face plate.

Another embodiment of the present invention is a device for facilitating unsealing the box sealed by the above procedure. The device is comprised of: a cut-forming device that forms a cut on the adhesive tape to function as a trigger to unseal the box; a first moving means that moves at least one of the mating portion of the box and the cut-forming device in a longitudinal direction of the mating portion; and a second moving means that moves at least one of the mating portion of the box and the cut-forming device in a direction approximately orthogonal to a longitudinal direction of the mating portion.

The tool and the device are used for forming the cut on a part of the adhesive tape facing the mating portion of the sealed box.

DETAILED DESCRIPTION OF THE INVENTION

Figure 1:
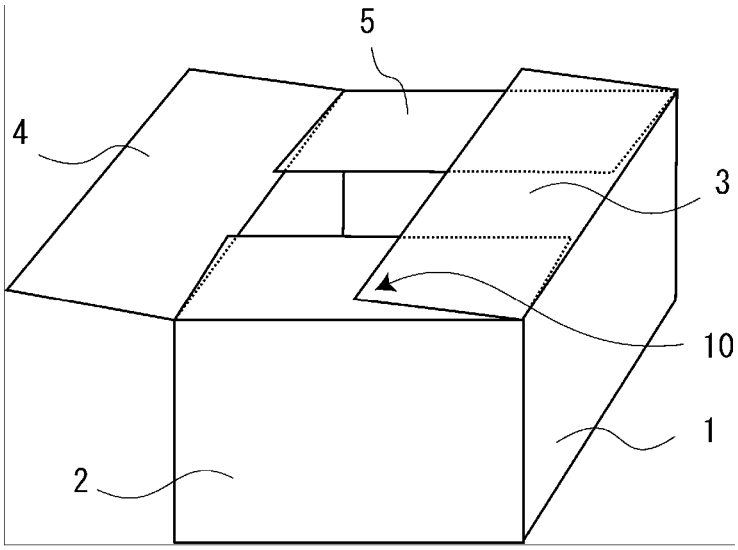
FIG. 1 is a perspective view of a box targeted in the present invention.

As shown in FIG. 1, a box of the present embodiment has a pair of side face plates 1 facing to each other and a pair of end face plates 2 facing to each other. Both the pair of side face plates 1 and the pair of end face plates 2 form a body portion having a square-cylindrical shape. A pair of outer flaps 3, 4 are formed continuously to edge portions of an opening side of the side face plates 1 to close an opening of the body portion having a square-cylindrical shape. The outer flaps 3, 4 are located on an upper side of inner flaps 5 which are formed continuously to edge portions of an opening side of the pair of end face plates 2. In the box, the pair of outer flaps 3, 4 are formed not continuously to the edge portions of the opening side of each of the end face plates 2.

When sealing the box, the edge portions of the pair of outer flaps 3, 4 form a mating portion at a side facing to each other. The box can be sealed by fixing the mating portion, a neighboring part of the mating portion and the end face plates 2 using an adhesive tape. Something other than the flaps can be connected to the lower edges of the side face plates 1 and the end face plates 2. The mating portion means a portion located between the edge portions of the pair of outer flaps 3, 4 in a state that the outer flaps 3, 4 are closed or a state that the outer flaps 3, 4 are in the middle of being closed.

The adhesive tape used for sealing the box is made of a film as a base material. The film is made from a synthetic resin, a cellophane and the like, and is easily teared when a cut is provided. Hereafter, the above described adhesive tape is referred to merely as "adhesive tape." The adhesive tape can be, for example, an OPP adhesive tape of a biaxially oriented polypropylene film (OPP film) made of polypropylene. The OPP adhesive tape is often used for sealing the box or other purposes. In the embodiments below, the adhesive tape made of a film as a base material is referred to merely as "adhesive tape" unless otherwise specified. Although the transparent adhesive tape is used to explain the embodiments below, the opaque adhesive tape is also available.

Figure 20:
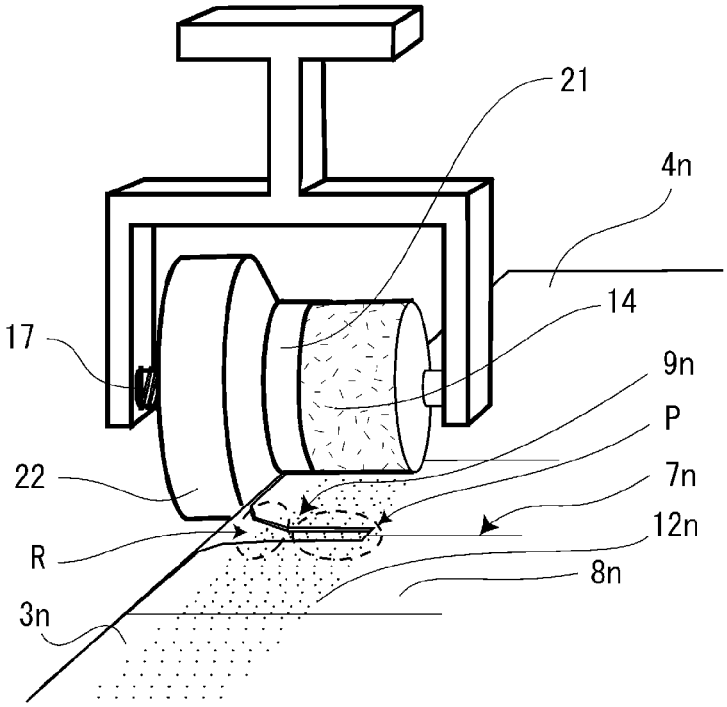
FIG. 20 is a perspective view showing a tool for facilitating to unseal the box concerning the sixth embodiment.
Figure 21:
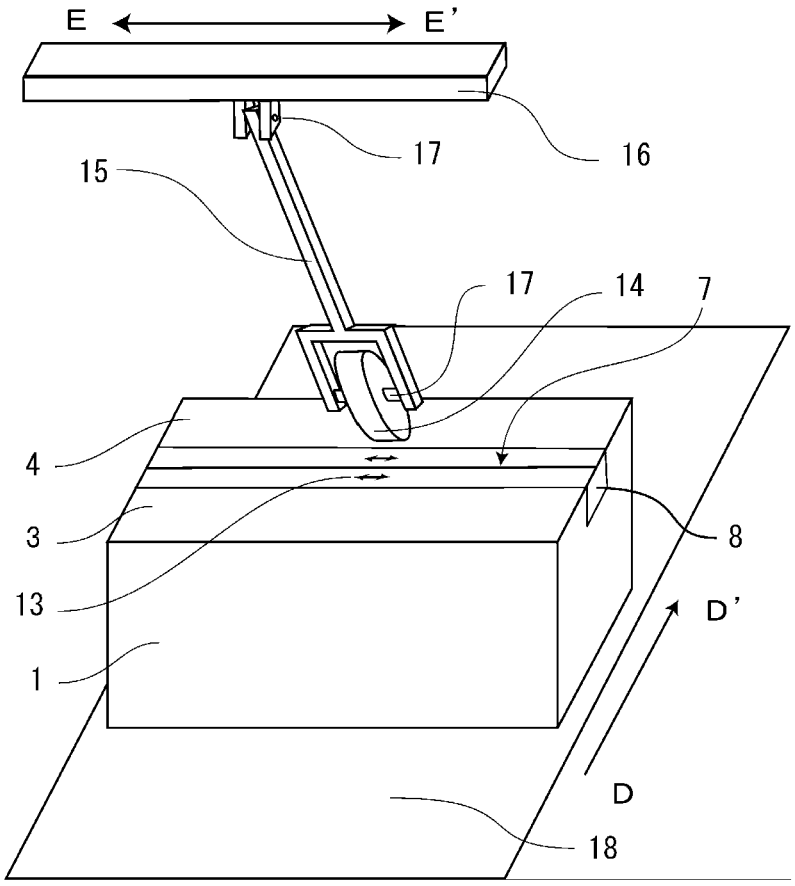
FIG. 21 is a perspective view showing a device for facilitating to unseal the box concerning the seventh embodiment.

Although various methods can be used for forming a cut on the adhesive tape, the cut shown in the present embodiment is formed by using a tool having needles on a roller surface as shown in FIG. 20 or a device shown in FIG. 21. Accordingly, the cut is formed to traverse a short-side length of the adhesive tape. The cut formed on the other portions than the mating portion, the clearance and the neighboring part of the mating portion and clearance don't have much influence when unsealing the box. When using the tool or the device of FIG. 20 and FIG. 21, although the cut is also formed on the outer flaps as shown in FIG. 20, the cut formed on the outer flaps is omitted in the other figures.

In the embodiments below, "mating portion formed by facing the edge portions of a pair of outer flaps to each other" is referred to merely as "mating portion" unless otherwise specified.

In addition, the values of the embodiments below are shown as an example unless otherwise specified. Thus, the present invention is not limited by these values.

First Embodiment

An easily openable box of the first embodiment of the present invention will be explained with reference to FIG. 2 and FIG. 3. Note that the first embodiment corresponds to claim 1.

Figure 2:
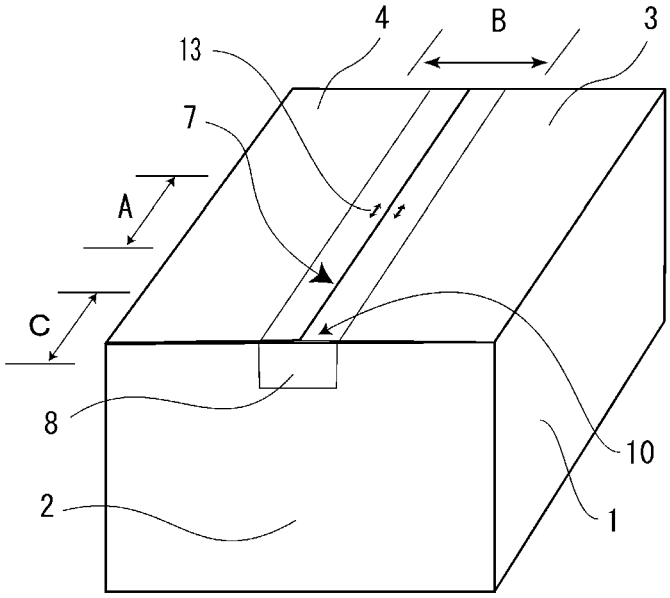
FIG. 2 is a perspective view of a box sealed by an adhesive tape concerning the first embodiment.

FIG. 2 is a perspective view showing a box of the first embodiment sealed by an adhesive tape 8. As shown in FIG. 2, allow marks 13 having a length of 10 mm are preliminarily printed on an approximately center of the box at a portion near the end portion of the mating portion of the outer flaps to indicate a forming position of the cut.

Figure 3:
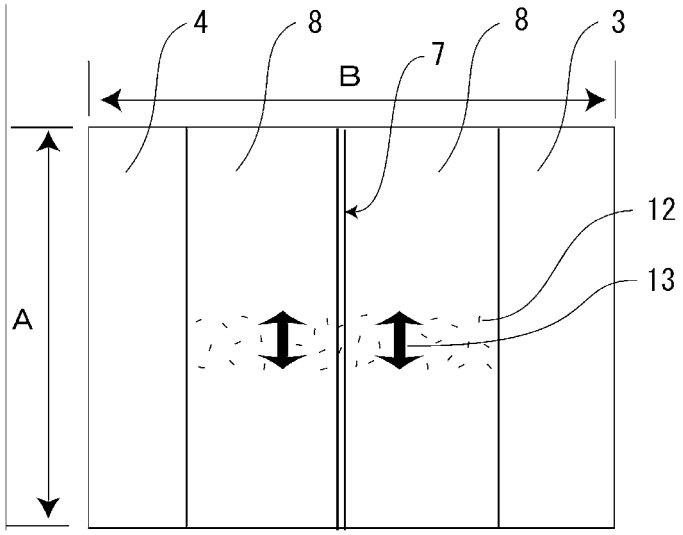
FIG. 3 is a plan view showing a part indicated by A-B in FIG. 2 concerning the first embodiment.

FIG. 3 is a plan view showing a part indicated by A-B in FIG. 2. FIG. 3 shows a state that a cut 12 to function as a trigger to unseal the adhesive tape 8 is formed on the adhesive tape 8 at a portion facing to a mating portion 7 located between two arrow marks 13 in a state that the box is sealed. In the figure, the cut is formed by using the device having needles on the roller surface shown in FIG. 21 as an example. Thus, the cut is formed on the other portions than the mating portion. The cut shown in FIG. 3 can be formed by piercing the adhesive tape using a needle tip, for example. The size of each of the cut is approximately 0.5 mm.

Operations and effects of the first embodiment will be explained by using FIG. 2 and FIG. 3.

In the method for facilitating unsealing the box, as an operation of the first embodiment, when the adhesive tape 8 is pushed down from the above by a nail tip at a portion of the mating portion 7 located between the arrow marks 13 indicating the forming position of the cut 12, the cut near the pushed part is deformed and changed into a crack by a strong force partly applied by the nail tip. When the nail is moved along the mating portion 7 while the nail is pushed down lightly, the crack is extended and the adhesive tape located at the mating portion is cut. When the outer flap 4 is pushed down from the above, a clearance is formed to enable a finger to be inserted in the mating portion 7. When the finger is inserted in the clearance to lift up the outer flap 3 located at the other side, the crack formed at the mating portion 7 when the adhesive tape is cut is further extended. Thus, the adhesive tape 8 located between the lifted outer flap 3 and the end face plate 2 is cut. Then, the other of the outer flaps 4 is lifted up to apply the force on the adhesive tape 8 between the outer flap 4 and the end face plate 2. Thus, the adhesive tape 8 is cut and unsealed.

In the first embodiment, the size of the cut 12 formed on the adhesive tape 8 is small (approximately 0.5 mm), the cut is not changed into a crack unless the strong force is applied. As explained above, the box is unsealed by using one of a plurality of cuts formed on the adhesive tape facing the mating portion. Accordingly, it is not necessary to form the perforation on the entire mating portion as required in the conventional technology. Because of this, there is little possibility that the box is unsealed by the force applied during transportation.

In the first embodiment, since the indicator showing the range of the cut is provided, a part to apply the force is made clear, and strong force can be easily applied partly by the nail tip or the like. Accordingly, even if the cut is small and difficult to be seen, such as the cut formed by piercing a needle tip, the crack can be formed to function as a trigger to unseal the adhesive tape.

Since the method shown in FIG. 21 is applied to the adhesive tape 8, the cut is also formed on the parts adhered to the outer flaps. However, because the adhesive tape is adhered to the outer flaps, even when the force is applied to these parts, the cut is not deformed and not changed into a crack.

As explained above, the box of the first embodiment is hardly unsealed during transportation and can be easily unsealed.

In the easily openable box concerning the present invention, a mating portion is formed by facing edge portions of a pair of outer flaps of the box to each other, and the box is sealed by fixing the mating portion, a neighboring part of the mating portion and an end face plate of the box using an adhesive tape made of a film as a base material.

In addition, a figure, a mark or other information showing a forming position of a cut to function as a trigger to unseal the box is indicated on the box, and the cut to function as the trigger to unseal the box is formed on the adhesive tape only at a portion facing to or neighboring to a part of the mating portion indicated as the forming portion.

In the present embodiment, in order to indicate the forming position of the cut, the arrow marks 13 are printed on the box. The arrow marks 13 correspond to a figure, a mark or other information. Of course, a figure, a mark or other information is not limited to the printed arrow marks 13. In the broadest sense, the printed arrow marks can be replaced with the cutout, the perforation or the slit formed on the box as shown in the second to fourth embodiments. Anything can be used as long as it is visible.

A lot of needle holes are formed at a predetermined area to form the cut by using a device having needles on a roller surface. However, the needle holes are merely an example. A lot of slits can be formed by using sharp protrusions having a plate-like shape as long as the slits can be formed within the range indicated by the indicator. Of course, perforations can be formed vertically and horizontally. When sealing a plurality of boxes having the same size, an area having a lot of cuts can be preliminarily formed on the adhesive tape in every constant length so that the area having the cuts is positioned to the arrows 13 when adhered to the box.

A lot of small protrusions can be preliminarily heated and brought into contact with the adhesive tape to form small holes by melting.

Although the size of the cut is approximately 0.5 mm, the size can be specified in a range from a half of this size to about several times of this size. For example, the range of approximately 0.2 mm to 3 mm can be considered.

In the present embodiment, the cut is formed at only one part. However, the cut can be formed at a plurality of parts. In such a case, a plurality of arrow marks 13 are printed so that the arrow marks 13 function as the indicator.

If the adhesive tape is made thicker, the cut is hardly deformed and not changed into a crack when the cut is small. Even in such a case, if a plurality of cuts is formed in a narrow area and distances between the cuts are made shorter, the adhesive tape between the cuts can be broken by the applied force and the crack can be formed. Accordingly, in the present invention, the cut formed on the adhesive tape at a portion facing the mating portion can be a plurality of cuts. In addition, the shape of the cut is not limited to a linear shape. The cut can be an irregular shape or a hole shape.

The information showing a forming position of a cut is not limited to the figures such as an arrow shown in the first embodiment. The information can be a word or a color, for example.

An easily openable box of the first variation example of the first embodiment of the present invention will be explained with reference to mainly FIG. 4. Note that the first variation example of the first embodiment corresponds to claim 1.

In the first variation example of the first embodiment, a cut is formed at a portion near the end face plate of the box.

Figure 4:
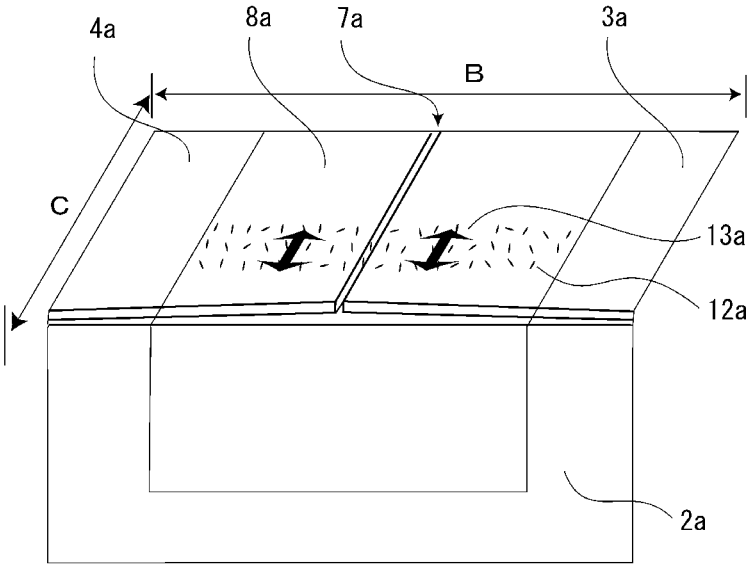
FIG. 4 is a perspective view showing a part indicated by C-B concerning the first variation example of the second embodiment.

FIG. 4 is a perspective view showing a part indicated by C-B in FIG. 2. As shown in FIG. 4, a mating portion 7*a* is formed by the edge portions of an outer flap 3*a* and an outer flap 4*a* at a side facing to each other, and indicators 13*a* indicating the forming position of the cut are preliminarily printed on the box at a portion near an end face plate 2*a*. In addition, a cut 12*a* is formed according to the indicators. In the figure, the cut is formed by using the tool having needles on the roller surface shown in FIG. 20 as an example. Thus, the cut is formed on the other portions than the mating portion. The cut is not formed on the adhesive tape at a portion neighboring to the end face plate.

Operations and effects of the first variation example of the first embodiment will be explained by using FIG. 4.

As an operation of the first variation example of the first embodiment, the method of unsealing the easily openable box is same as the first embodiment.

The adhesive tape between the outer flap lifted up finally and the end face plate are cut by the force in the first embodiment. In the first variation example of the first embodiment, a plurality of cuts are formed on the adhesive tape at a potion facing to the mating portion near the end face plate and a surrounding area. Among the plurality of cuts, the cuts, which are not used before the final outer flap is lifted up, function as a trigger to break the adhesive tape. Thus, the adhesive tape thicker than the first embodiment can be unsealed.

In the first variation example of the first embodiment, there is less possibility that the box is unintentionally unsealed even when the force pushed from the above is applied during transportation compared to the first embodiment. This is because the force is distributed by the end face plate and the inner flaps even when the end of the box is pushed. Thus, the strong force is not applied to the cut. When the center of the upper surface of the box is pushed, the outer flap located at the center is lowered so as to be pushed down, and the force to expand the mating portion is applied to the mating portion located near the center. At that time, the width of the mating portion located near the end face plate becomes narrow in an opposite manner. Thus, the strong force is not applied to the cut formed on the mating portion near the end face plate and the crack is hardly formed. Since the cut is not formed on the portion near the end face plate in the first variation example of the first embodiment, there is less possibility that the adhesive tape is unintentionally cut or unsealed during translation even when the force to pull the adhesive tape between the outer flap and the end face plate is applied.

Second Embodiment

An easily openable box concerning the second embodiment of the present invention will be explained with reference to FIG. 5 and FIG. 6.

In the second embodiment, a clearance is formed on the mating portion instead of the indicator of the arrow marks indicating the forming position of the cut of the first embodiment.

Figure 5:
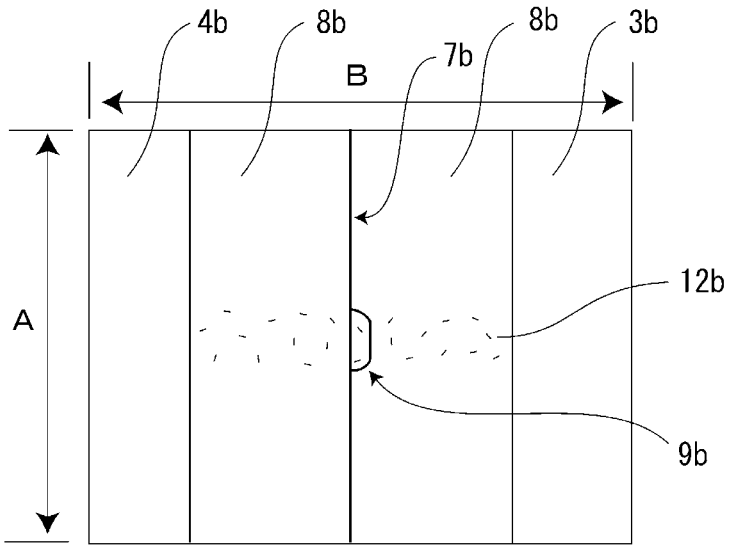
FIG. 5 is a plan view showing a part indicated by A-B concerning the second embodiment.

FIG. 5 is a plan view showing the clearance. FIG. 5 corresponds to A-B in FIG. 2 of the first embodiment.

As shown in FIG. 5, the second embodiment is characterized in that a clearance 9*b* having an approximately trapezoidal shape is formed at the center of the box on a mating portion 7*b* of the edge portions of an outer flap 3*b* and an outer flap 4*b* facing to each other. As shown in the development view of FIG. 6, a cutout 6*b* is formed on the edge of the mating portion side of the outer flap 3*b* located at an opening surface of the box to form the clearance 9*b*.

In FIG. 5, the width (length in a direction orthogonal to the mating portion 7*b*) of the clearance 9*b* is 3 mm, and the length (length in a direction of the mating portion 7*b*) of the clearance 9*b* is 10 mm. In FIG. 5, a cut 12*b* formed on the adhesive tape by using the device shown in FIG. 21 is shown as an example.

In the present embodiment, the clearance 9*b* is formed on the mating portion and the width (length in a direction orthogonal to the mating portion) of the clearance 9*b* is within 1 mm to 5 mm. At least one of the outer flaps is preliminarily cut partly at the edge portions forming the mating portion so that the length (longitudinal length in a direction of the mating portion 7*b*) of the clearance 9*b* is within 5 mm to 20 mm.

Furthermore, a cut to function as a trigger to unseal the box is formed on the adhesive tape at a portion facing to the clearance in a state that the outer flaps are sealed.

Note that the size of the clearance 9*b* can be relatively adjusted on the assumption that the width of the adhesive tape is 35 mm or 50 mm.

Operations and effects of the second embodiment will be explained by using FIG. 5 and FIG. 6.

If the edge portions of the outer flap 3*b* and the outer flap 4*b* facing to each other are assembled to be in close contact with each other without forming a clearance in order to increase the strength of the box and the box is sealed by the adhesive tape same as the first embodiment, the mating portion becomes narrow like a line and therefore it is difficult to form the cut, which function as a trigger to unseal the box, certainly on a narrow range of the longitudinal direction of the mating portion.

Figure 6:
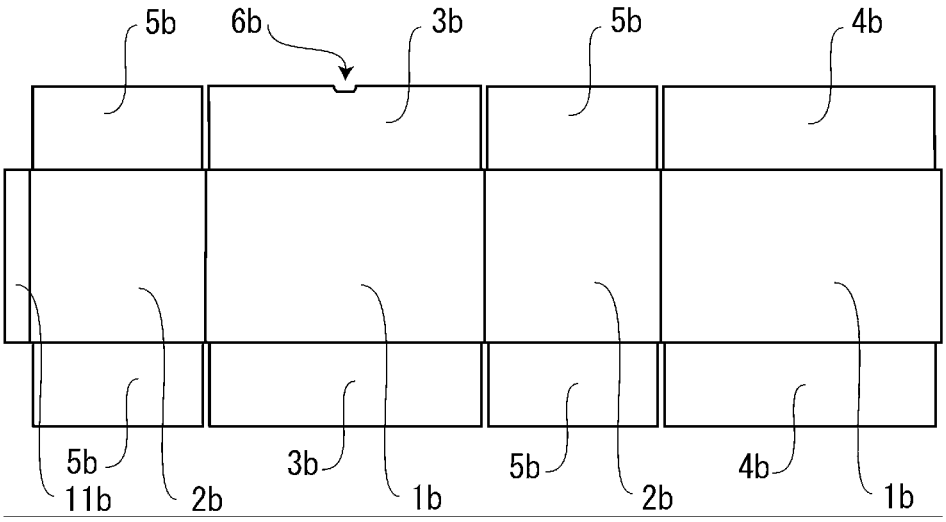
FIG. 6 is a development view of the box concerning the second embodiment.

However, in the box shown in the development view of FIG. 6 of the second embodiment, the clearance 9*b* having a width of 3 mm and a length of 10 mm is formed at the center of the box on the mating portion 7*b* as shown in the plan view of FIG. 5. Since the width of the clearance 9*b* is narrow (3 mm), the adhesive tape located at the clearance is not adhered to any part of the box. In addition, the adhesive tape is not loosened even if it is pushed by the needle. Thus, the cut 12*b* to function as a trigger to unseal the box can be formed on an adhesive tape 8*b* at a portion facing to the clearance 9*b*.

When unsealing the adhesive tape, since the clearance 9*b* indicates the position of the cut 12*b*, the crack can be formed on the adhesive tape 8*b* by pushing a part of the clearance 9*b*. After that, the box can be unsealed by using the method same as the first embodiment.

The area of the clearance 9*b* is relatively small when compared to the area of the adhesive tape sealing the box. Thus, the sealing ability of the box is approximately same as usual. Accordingly, even if the unintentional force is applied to the cut 12*b*, there is little possibility that the box is unintentionally unsealed. Since the width (length in a direction orthogonal to the mating portion 7*b*) of the clearance 9*b* is narrow, the adhesive tape is hardly loosened. In addition, since the strong force can be easily applied partly on the cut by the nail or the like, the cut can function as a trigger to unseal the box even if the cut is small.

Although the clearance is an approximately trapezoidal shape in the second embodiment, the clearance can be a semi-circular shape or an irregular shape and same effect can be obtained as long as the size is same.

The clearance can be formed on both edge portions of the outer flap 3*b* and the outer flap 4*b* facing to each other so that a larger clearance can be formed when both edges are faced to each other. The edge portions facing to each other can be formed in a wave shape or a saw blade shape. Alternatively, recesses can be formed on both edge portions of the outer flap 3*b* and the outer flap 4*b* facing to each other so that the recesses are faced to each other when both edges are faced to each other.

As explained above, by forming the cutout 6*b* having a small size on the edge of the mating portion side, the cut 12*b* to function as a trigger to unseal the box can be certainly formed on the adhesive tape without losing the sealing ability of the box. In addition, the clearance also functions as a mark indicating the forming position of the cut. Thus, the box can be easily unsealed although there is little possibility that the box is unsealed by the unintentional force.

Third Embodiment

The third embodiment of the present invention will be explained with reference to FIG. 7, FIG. 8 and FIG. 9. Note that the third embodiment corresponds to claim 2.

Figure 7:
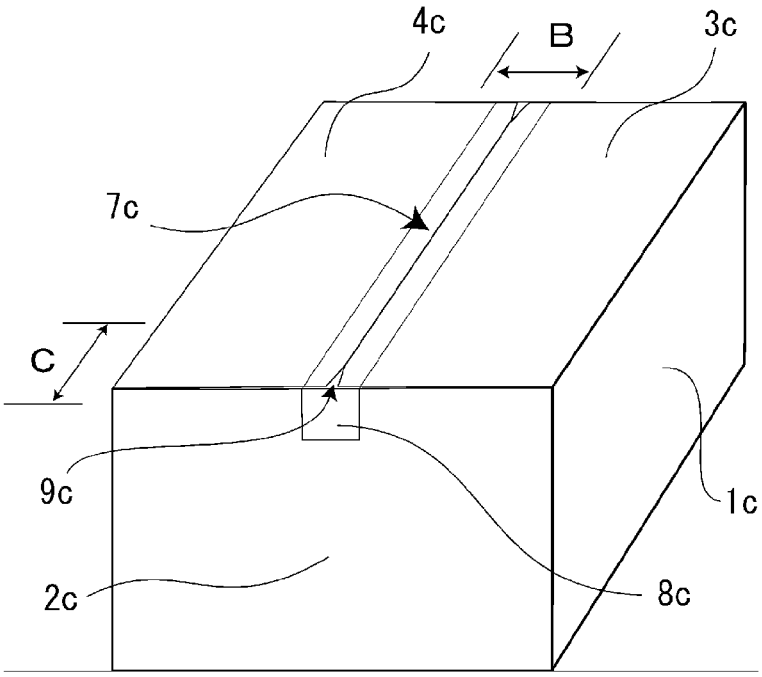
FIG. 7 is a perspective view showing a box sealed by an adhesive tape concerning the third embodiment.

As shown in FIG. 7, the box of the third embodiment has a clearance 9*c* having an approximately triangular shape in a plan view. The clearance 9*c* is formed on a mating portion 7*c* between an outer flap 3*c* and an outer flap 4*c* located at an opening surface of the box, and is adjacent to an end face plate 2*c*.

Figure 8:
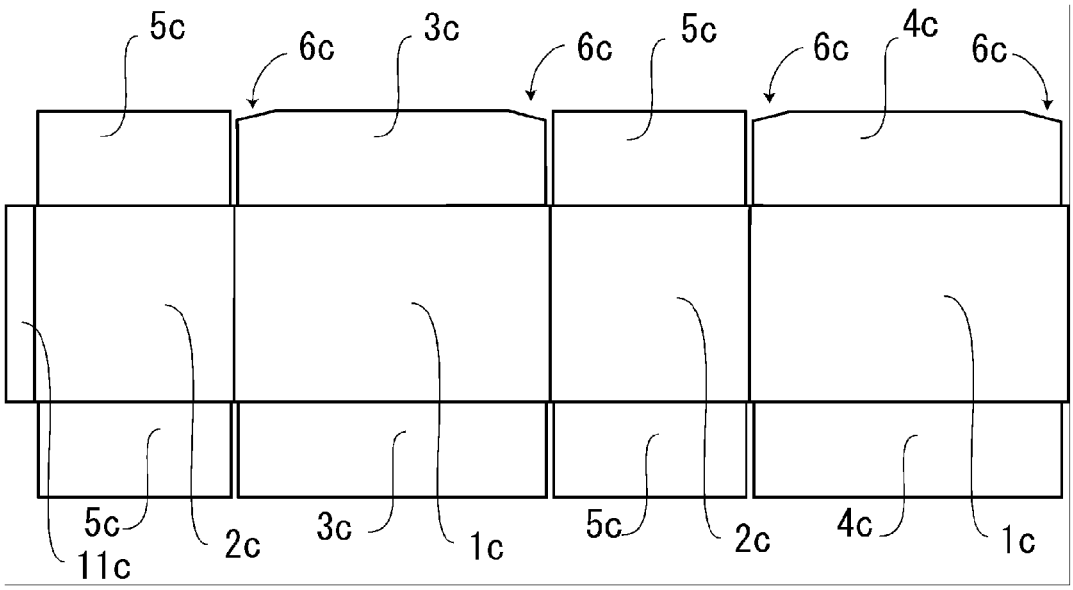
FIG. 8 is a development view of the box of the third embodiment.

FIG. 8 is a development view of the box of the third embodiment. As shown in the figure, the outer flaps are cut along a line connecting a first point and a second point. The first point is separate 5 mm in a direction along an edge of the end face plate side of the outer flaps from a corner of the mating portion side of each of the outer flaps located at the opening surface. The second point is separate 20 mm in a direction along an edge of the mating portion side of the outer flaps from the corner. Here, the corner is an intersection point between the edge of the mating portion side of the outer flaps and the edge of the end face plate side of the outer flap.

Figure 9:
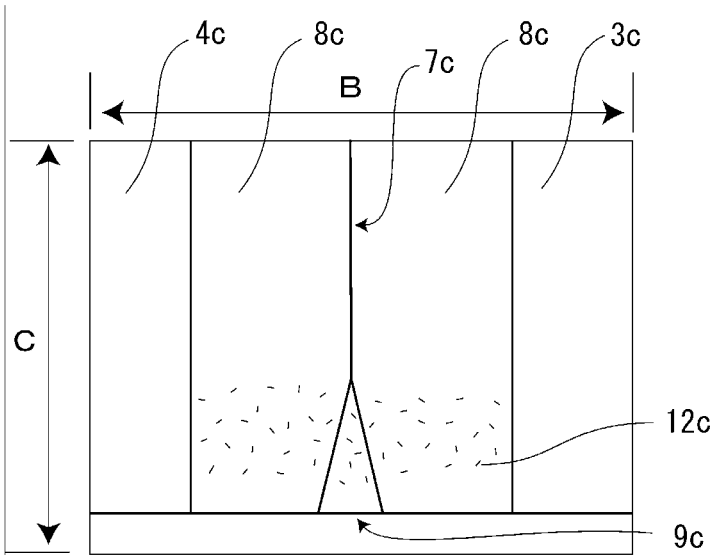
FIG. 9 is a plan view showing a part indicated by C-B concerning the third embodiment.

FIG. 9 is a plan view showing a part indicated by C-B in FIG. 7.

The clearance 9*c* shown in FIG. 9 is formed by a cutout 6*c* shown in FIG. 8. The maximum width (length in a direction orthogonal to the mating portion 7*c*) of the clearance 9*c* is 10 mm.

The adhesive tape used for sealing the box generally has a width of an approximately 50 mm or an approximately 35 mm in a short-side direction. Since the maximum width of the clearance 9*c* in the third embodiment is 10 mm, the width of the clearance 9*c* is less than a half of the width in the short-side direction of the adhesive tape used for sealing.

As shown in FIG. 9, a cut 12*c* to function as a trigger to unseal an adhesive tape 8*c* is formed on the adhesive tape 8*c* at a portion of the clearance 9*c* separate 5 mm or more from an edge of the end face plate side of the outer flaps.

In the present embodiment, the clearance 9*c* is formed on the mating portion at a range within 30 mm from the edge of the end face plate. At least one of the outer flaps is preliminarily cut partly at the edge portions forming the mating portion so that the width (length in a direction orthogonal to the mating portion) of the clearance 9*c* is within 5 mm to 25 mm and a length of the clearance is equal to or less than two thirds (⅔) of a short-side length of the adhesive tape. Although the size of the clearance 9*c* is appropriately specified in the present embodiment, the size can be arbitrarily changed.

A cut to function as a trigger to unseal the box is formed on the adhesive tape at a portion facing to the clearance and a surrounding area of the clearance in a state that the outer flaps are sealed.

Operations and effects of the third embodiment will be explained by using FIG. 10.

Figure 10:
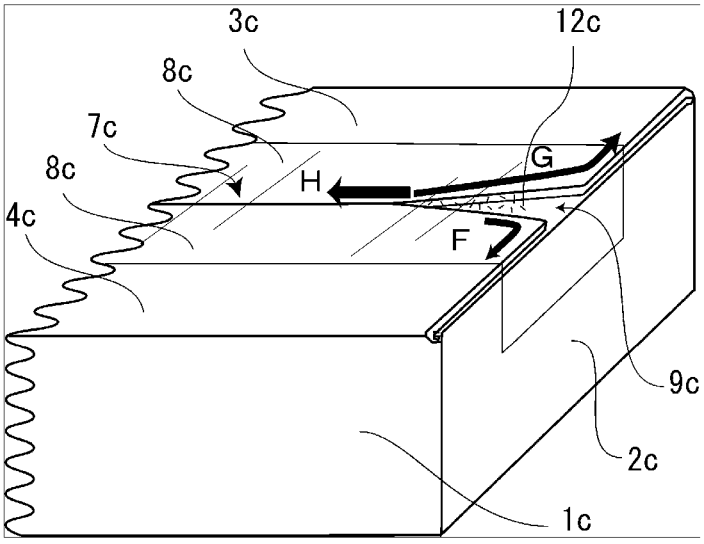
FIG. 10 is a perspective view explaining an operation to unseal the box concerning the third embodiment.

FIG. 10 is a perspective view showing the right half of the box of the third embodiment to show mainly a part of the clearance. The width (length in a direction orthogonal to the mating portion 7*c*) of the clearance in the third embodiment is small (maximally 10 mm), and the width becomes narrower as it goes apart from the end face plate 2*c*. Accordingly, the adhesive tape 8*c* is not loosened and not adhered to the inner flaps. Because of this, when the strong force is partly applied by the nail or the like on the adhesive tape 8*c* at a portion where the clearance 9*c* becomes narrower to unseal the box, the cut 12*c* located at the portion is changed into a crack by the force partly applied by the nail.

As explained above, the outer flaps are obliquely cut so that the width of the clearance becomes narrower as it goes apart from the end face plate 2*c*. As a result, the clearance is formed in a triangular shape and the above described effects can be obtained.

When the nail is moved in the H-direction along the mating portion 7*c* while the nail is pushed, the crack is extended and the adhesive tape 8*c* is cut along the mating portion 7*c*. Then, the outer flap 4*c* is pressed from the above to form a clearance of the mating portion 7*c* between the outer flap 4*c* and the outer flap 3*c*, and then the finger is inserted into the clearance to lift up the outer flap 3*c*. When the outer flap 3*c* is lifted up, the crack formed in the direction of the mating portion is extended in the G-direction, and the adhesive tape 8*c* fixing the lifted outer flap 3*c* with the end face plate 2*c* is cut.

When the outer flap 4*c*, which is the other of the outer flaps, is lifted up, the force is applied to the cut 12*c* formed on the adhesive tape and still left on the clearance 9*c*. Then, a crack is newly formed and extended in the F-direction. Thus, the adhesive tape 8*c* fixing the lifted outer flap 4*c* and the end face plate 2*c* is cut and the box is unsealed.

As explained above, same as the second embodiment, the clearance 9*c* of the third embodiment has a role to easily form the cut 12*c* on the adhesive tape and a role to form a crack in the H-direction of the mating portion because the force can be easily applied to the cut 12*c* when the narrow part of the clearance 9*c* is pushed by the nail tip. In addition, the cut formed on the wide part (part near the end face plate 2*c*) of the clearance 9*c* has a role to extend the crack in the end face plate direction when the outer flap is lifted up. In the third embodiment, the box can be unsealed with smaller force when compared to the first embodiment.

In addition, since the area of the clearance 9*c* having an approximately triangular shape is sufficiently small when compared to the area of the adhesive tape 8*c* sealing the box, the sealing ability of the box is not decreased almost at all. Furthermore, since the length (length from the end face plate 2*c* to an apex of the approximately triangular shape) of the clearance 9*c* is 20 mm, the cut 12*c* can be formed on the adhesive tape 8*c* at a portion of the clearance which is separate (separate 5 mm in the third embodiment) from the edge of the end face plate side of the outer flaps. From the above, same as the first variation example of the first embodiment, there is little possibility that the adhesive tape is unintentionally cut even when the force is applied to the adhesive tape between the end face plate 2*c* and the outer flaps.

In case the outer flap lifted up firstly is preliminarily determined, only the other outer flap can be preliminarily cut.

The first variation example of the third embodiment of the present invention will be explained with reference to mainly FIG. 11 and FIG. 12. The first variation example of the third embodiment corresponds to claim 2.

Figure 12:
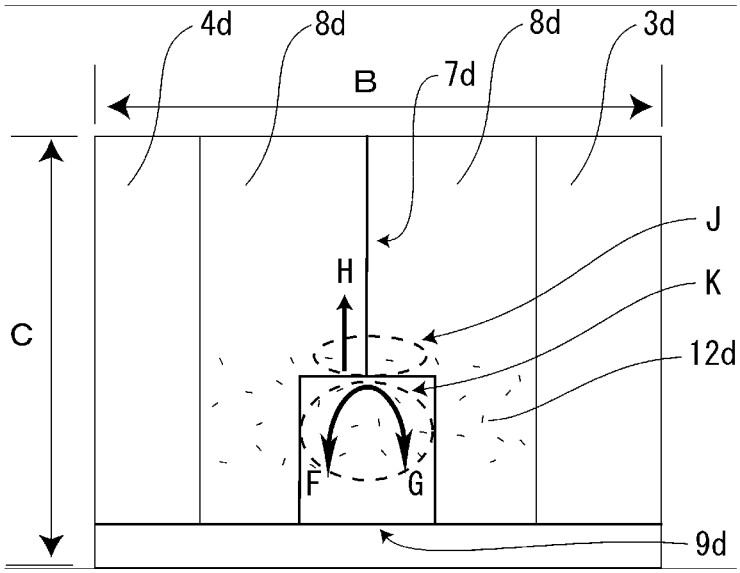
FIG. 12 is a plan view showing a part indicated by C-B concerning the first variation example of the third embodiment.

In the first variation example of the third embodiment, the clearance 9*c* of the third embodiment is replaced by a clearance 9*d* having a rectangular shape in a plan view as shown in FIG. 12.

Figure 11:
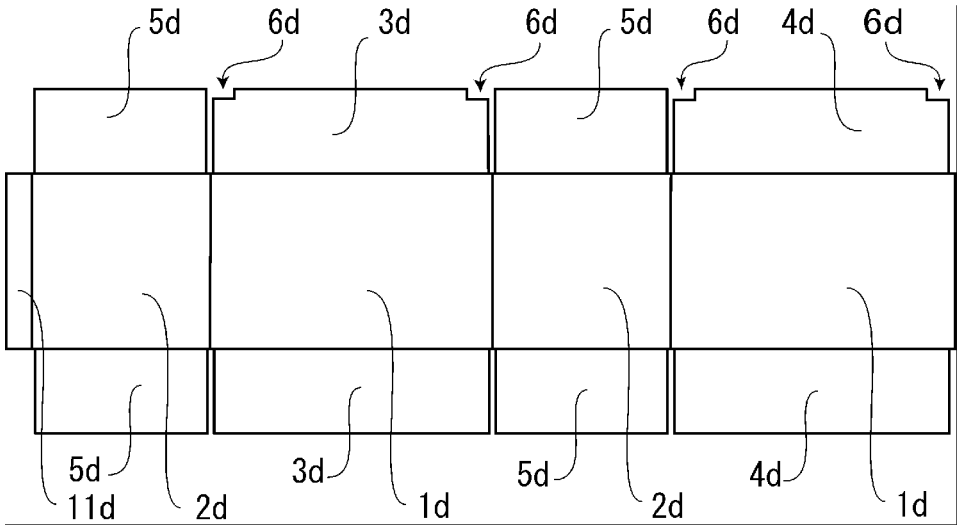
FIG. 11 is a development view of the box concerning the first variation example of the third embodiment.

FIG. 11 is a development view of the first variation example of the third embodiment. A cutout 6*d* shown in FIG. 11 is a cut to form a rectangular shape having a first side and a second side. The first side is separate 10 mm along an edge of the end face plate side of the outer flaps 3*d*, 4*d* from a corner of the mating portion side of each of the outer flaps 3*d*, 4*d*. The second side is separate 20 mm along an edge of the mating portion 7*d* side from the corner. The corner is an intersection point between the edge of the mating portion side of the outer flaps and the edge of the end face plate 2*c* side of the outer flap.

FIG. 12 is a plan view showing a part indicated by C-B in FIG. 7 in a state that the box is sealed by the adhesive tape. When the box is sealed, the cutout becomes a rectangular shape having a length of 20 mm in the direction orthogonal to the mating portion and a length of 20 mm in the direction of the mating portion. In the first variation example of the third embodiment, a cut 12*d* to function as a trigger to unseal the box is formed at a portion separate 10 mm or more from an edge of the end face plate side of the outer flaps.

Operations and effects of the first variation example of the third embodiment will be explained by using FIG. 12.

When unsealing the box, the adhesive tape is pushed by a thumb from the above at a portion of the clearance 9*d* shown in FIG. 12. Because of this, the cut formed on the portion of the clearance in the adhesive tape is changed into a crack in the F-G direction crossing the mating portion. When the strong force is partly applied by the nail or the like to the adhesive tape facing the mating portion 7*d* located at a portion J shown in FIG. 12, the cut 12*d* of the adhesive tape is changed into a crack. When the nail is moved in the H-direction along the mating portion 7*d* while the nail is pushed, the crack is extended and the adhesive tape 8*d* is cut along the mating portion 7*d*. The outer flap 4*d* is pressed from the above to form a clearance between the outer flap 4*d* and the outer flap 3*d*, and then the finger is inserted into the clearance and the outer flap 3*d* is lifted up. By doing so, the crack formed in the mating portion direction is connected with the crack formed in the F-G direction and extended in the G-direction. Thus, the adhesive tape 8*d* between the outer flap 3*d* and an end face plate 2*d* is cut. When the outer flap 4*d*, which is the other of the outer flaps, is lifted up, the crack in the F-direction is extended to cut the adhesive tape between the outer flap 4*d* and the end face plate 2*d*. Thus, the box can be easily unsealed.

In the first variation example of the third embodiment, since the width of the clearance 9*d* having a rectangular shape is wider than the third embodiment, the crack in the F-G direction is more easily formed by an unintentional force. However, when the crack is formed, a part of the adhesive tape 8*d* located at the clearance 9*d* is adhered to an inner flap 5*d*. Accordingly, the crack is not extended to cut the adhesive tape between the outer flaps and the end face plate 2*d* only by the force applied from the above. Unless the outer flap is lifted up largely, the crack is not extended. Therefore, there is little probability that the adhesive tape between the outer flaps and the end face plate 2*d* is cut except for when unsealing the box. Other effects are same as the third embodiment.

As explained above, in the first variation example of the third embodiment, in addition to the effects of the third embodiment, the box can be more easily unsealed because the crack can be easily formed in the F-G direction crossing the mating portion.

Note that the clearance shown in the second embodiment can be formed on the J-portion.

The second variation example of the third embodiment of the present invention will be explained with reference to mainly FIG. 13 and FIG. 14.

Figure 13:
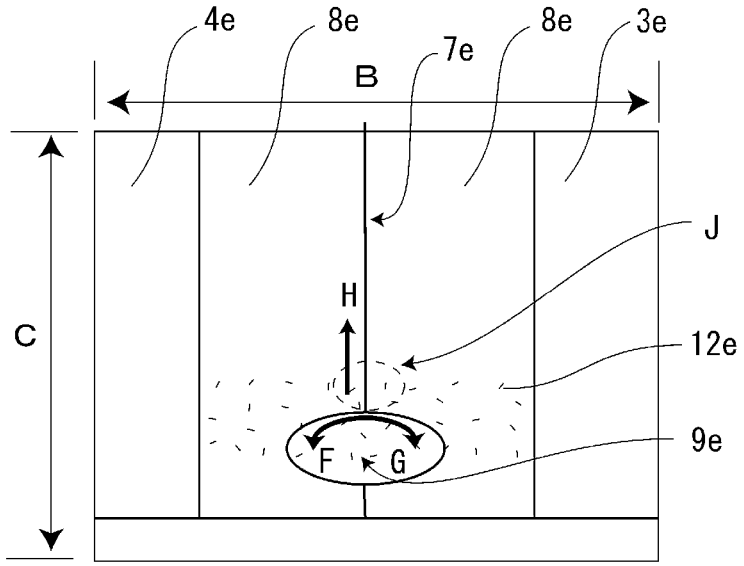
FIG. 13 is a plan view showing a part indicated by C-B concerning the second variation example of the third embodiment.

In the second variation example of the third embodiment, the clearance 9*c* of the third embodiment is replaced by a clearance 9*e* having an elliptical shape in a plan view as shown in FIG. 13.

FIG. 13 is a plan view showing a part indicated by C-B in FIG. 7. The clearance 9*e* shown in FIG. 13 is formed by cutting an edge of the mating portion side of the outer flaps so that the clearance 9*e* having an elliptical shape is formed at a portion within 5 mm to 15 mm from the edge of the end face plate. Diameters of the clearance 9*e* having an elliptical shape are 10 mm and 20 mm. The longer diameter is located in a direction orthogonal to a mating portion 7*e*. As shown in FIG. 13, the cut is formed on an adhesive tape 8*e* at a portion separate 10 mm or more from an edge of the end face plate side of the outer flaps.

Figure 14:
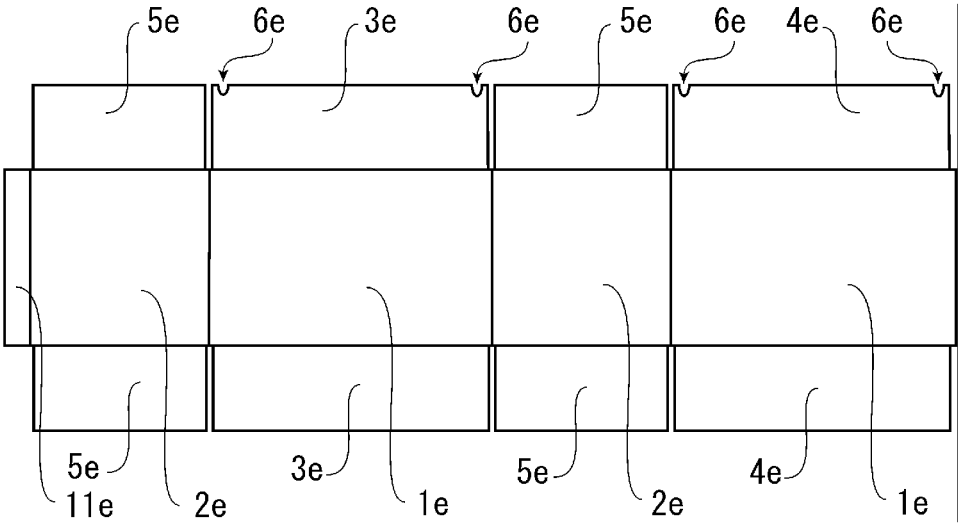
FIG. 14 is a development view of the box concerning the second variation example of the third embodiment.

As shown in the development view of FIG. 14, the clearance 9*e* is formed by cutting both ends of the edge portion of the mating portion side of the outer flaps located at an opening surface of the box.

Operations and effects of the present embodiment will be explained by using FIG. 13.

When unsealing the box, the adhesive tape 8*e* is pushed by a nail of a thumb from the above at a portion facing the clearance 9*e* shown in FIG. 13. Because of this, a crack is formed along the shape of the thumb in the F-G direction crossing the mating portion. The method of unsealing the box after the above described procedure is same as the first variation example of the third embodiment.

In the second variation example of the third embodiment, the clearance 9*e* is not open to the end face plate side. Because of this, even when the strong force is applied to the cut and a crack is formed on the adhesive tape at a portion of the clearance 9*e*, the crack is not extended to the adhesive tape 8*e* between the outer flaps and an end face plate 2*e*. Therefore, even when an unintentional force is applied, there is less possibility that the adhesive tape is unintentionally unsealed when compared to the first variation example of the third embodiment.

When one the outer flaps lifted up to unseal the box, the adhesive tape 8*e* is peeled off from the outer flaps partly at a portion near the end face plate 2*e* and then the adhesive tape 8*e* between the outer flaps and the end face plate 2*e* is cut. However, since the area to be peeled off is small, the sealing ability is not reduced so much even when re-using the box. Other effects are same as the third embodiment.

In case the outer flap lifted up firstly is preliminarily determined, the clearance 9*e* having an elliptical shape can be formed by cutting only the other of the outer flaps.

Note that the shape of the clearance can be any shape other than the shape of the present embodiment as long as the crack can be formed in the F-G direction. The clearance can be formed in a heart shape, an inverse triangular shape, a diamond shape or an irregular shape.

Fourth Embodiment

Figure 15:
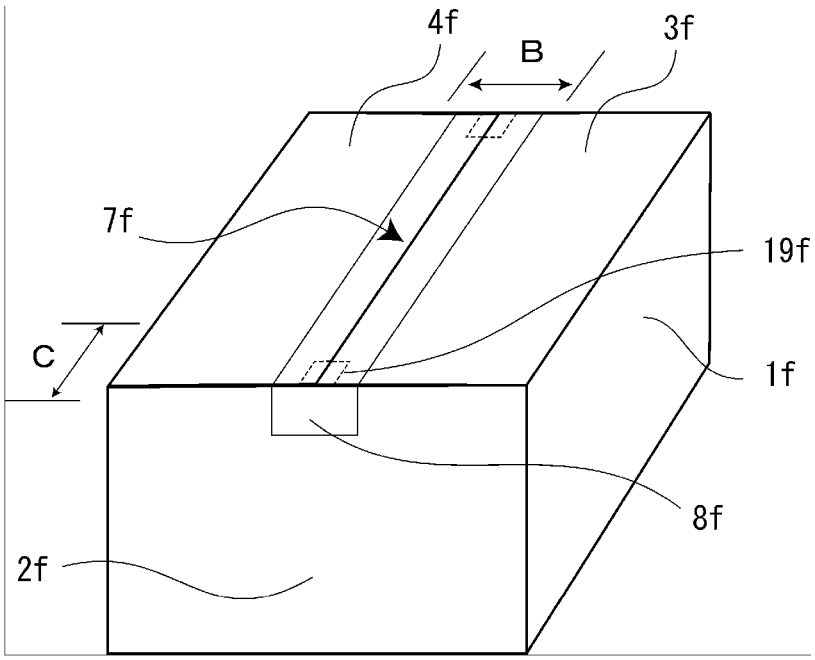
FIG. 15 is a perspective view of a box sealed by an adhesive tape concerning the fourth embodiment.

The fourth embodiment of the present invention will be explained with reference to FIG. 15 and FIG. 16. The fourth embodiment corresponds to claim 3.

In an easily openable box of the fourth embodiment, a perforation 19*f* having an approximately rectangular shape in a plan view is formed on the outer flaps at a portion neighboring to an end face plate 2*f*. FIG. 16 is a plan view showing a part indicated by C-B in FIG. 15.

Figure 16:
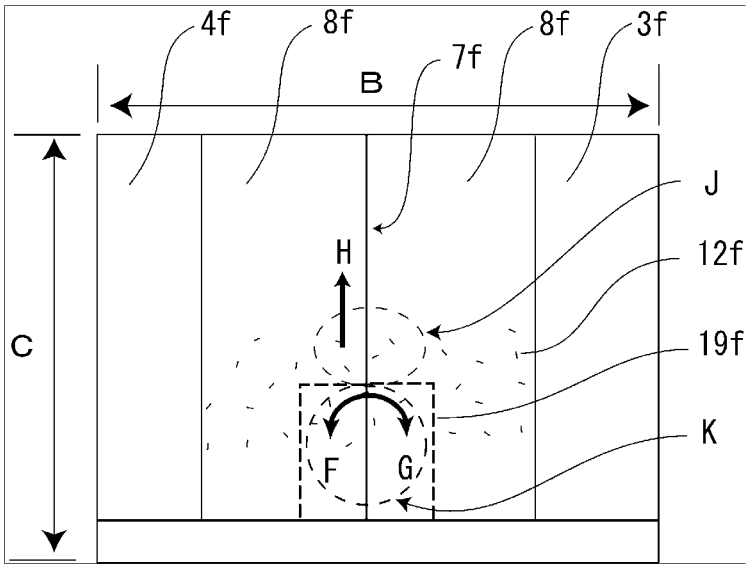
FIG. 16 is a plan view showing a part indicated by C-B concerning the fourth embodiment.

As shown in FIG. 16, the box of the fourth embodiment is formed by replacing the clearance 9*d* of the first variation example of the third embodiment shown in FIG. 12 with the perforation 19*f*. The perforation 19*f* can be broken (removed) by applying the force. When the perforation 19*f* is entirely removed, the removed part functions as the clearance 9*d* of the first variation example of the third embodiment.

A cut 12*f* formed on the adhesive tape shown in FIG. 16 is formed on an adhesive tape 8*f* separate 10 mm or more from an edge of the end surface side of the outer flaps after the box of the fourth embodiment is sealed by the adhesive tape 8*f*.

When unsealing the box, the portion K shown in FIG. 16 surrounded by the perforation 19*f* is pushed by a thumb from the above. Because of this, the perforation 19*f* formed on the outer flaps is broken and the clearance is formed on the box. In addition, the adhesive tape 8*f* is peeled off from the outer flaps at a portion of the clearance. Thus, the cut 12*f* formed on this portion is changed into a crack in the F-G direction crossing the mating portion. The method of unsealing the box after the above described procedure is same as the first variation example of the third embodiment.

As explained above, in the present embodiment, a perforation is formed on at least one of the outer flaps at a range within 40 mm from an edge of the end face plate in a longitudinal direction of the mating portion, within 25 mm from the edge portion of the mating portion side of the outer fraps in a direction orthogonal to the longitudinal direction, and equal to or less than two thirds (⅔) of a short-side length of the adhesive tape. The perforation is orthogonal to or oblique to the longitudinal direction of the mating portion. Although the size of the perforation 19*f* is specified properly, the size can be arbitrarily changed.

In addition, a part of the outer flaps can be pushed inside the box when the perforation is pushed. Furthermore, a cut to function as a trigger to unseal the box is formed on the adhesive tape at a portion facing a surrounding area of the perforation.

In the fourth embodiment, in addition to the effects of the first variation example of the third embodiment, there is little possibility that the box is unsealed by an unintentional force because only the perforation 19*f* is provided without providing the clearance before unsealing the box.

Note that it is important in the fourth embodiment that a crack is formed in the F-G direction crossing the mating portion on the clearance of the outer flaps when the perforation is pushed to form the clearance. It is not necessary to entirely break the perforation 19 and not necessary to form the clearance same as the clearance 9*d* shown in the first variation example of the third embodiment. Even in such a case, when the outer flaps are lifted up, the crack formed in the F-G direction is extended while the adhesive tape 8*f* adhered to the outer flaps is partly peeled off, and the adhesive tape 8*f* between the outer flaps and the end face plate 2*f* is cut.

In case the outer flap lifted up firstly is preliminarily determined, only the other outer flap can be preliminarily cut.

If the perforation of the outer flaps is formed on near the end face plate 2*f*, it may be difficult to push down the perforation because of an inner flap 5*f*. Therefore, the inner flap 5*f* can be partly cut at this portion.

Fifth Embodiment

An easily openable box of the fifth embodiment will be explained with reference to FIG. 17 and FIG. 18.

Figure 17:
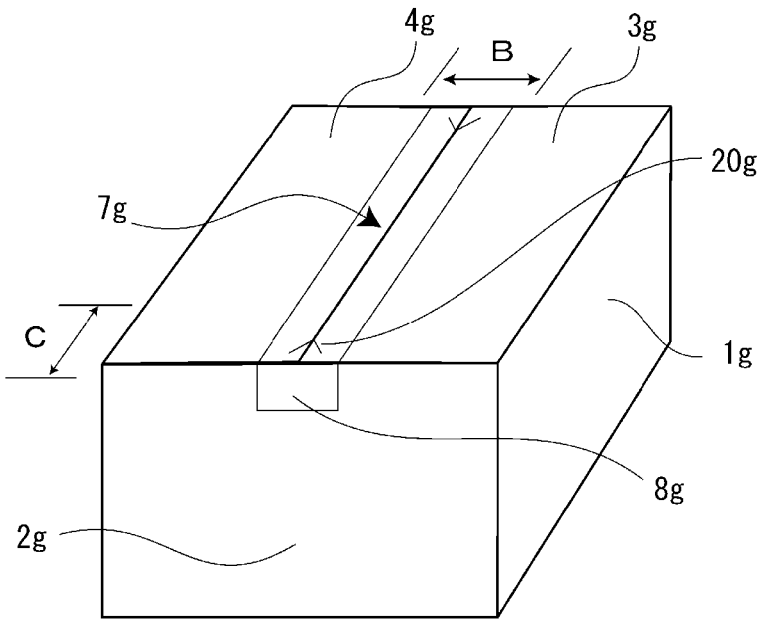
FIG. 17 is a perspective view showing a box sealed by an adhesive tape concerning the fifth embodiment.

As shown in FIG. 17, in the box of the fifth embodiment, a slit 20*g* is formed on the outer flaps at a portion near an end face plate 2*g*. FIG. 18 is a plan view showing a part where the slit 20*g* is formed and indicated by C-B in FIG. 17.

Figure 18:
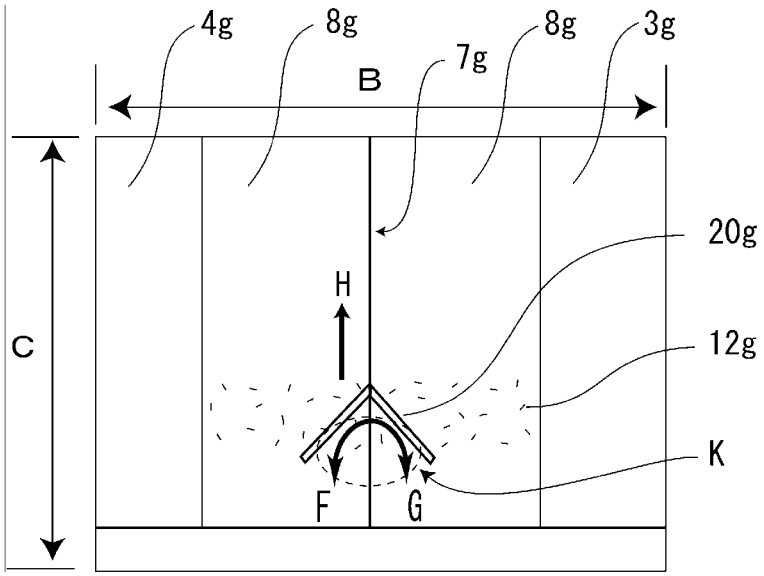
FIG. 18 is a plan view showing a part indicated by C-B concerning the fifth embodiment.

The slit 20*g* shown in FIG. 18 is formed in a range within 10 mm to 20 mm from an edge of the end face plate side of the outer flaps. The slit 20*g* is formed in a mountain shape (reverse V-shape) when viewed from the end face plate 2*g* side. A width of the slit is 2 mm, and a length of the slit is 14 mm. The slit is obliquely crossed with the mating portion at an angle of plus/minus 45°. One end of the slit is open to the mating portion at a portion far from the end face plate.

A cut 12*g* of the fifth embodiment shown in FIG. 18 is formed on an adhesive tape 8*g* at a surrounding area of the slit 20*g* separate 10 mm or more from an edge of the end surface side of the outer flap.

As explained above, in the present embodiment, a slit orthogonal to or oblique to the longitudinal direction of the mating portion and having a width of 5 mm or less is formed on at least one of the outer flaps. The slit is formed at a range within 40 mm in a longitudinal direction of the mating portion from an edge of the end face plate. The slit is formed within 25 mm in a direction orthogonal to the longitudinal direction from the edge portion of the mating portion side of the outer fraps. The slit is formed within equal to or less than two thirds (⅔) of a short-side length of the adhesive tape in a direction orthogonal to the longitudinal direction from the edge portion of the outer fraps. Although the size of the slit 20*g* is specified properly, the size can be arbitrarily changed. Note that the perforation 19*f* and the slit 20*g* can be alternately and consecutively formed.

In addition, a part of the outer flaps can be pushed inside the box when the slit is pushed. Furthermore, a cut to function as a trigger to unseal the box is formed on the adhesive tape at a portion facing a surrounding area of the slit.

Of course, the angle of forming the slit 20*g* and the perforation 19*f* is not limited to 45°. For example, the angle can be specified to approximately 20° to 70°, although an optimum angle is around 45°. The angles of the slit 20*g* and the perforation 19*f* are not necessarily matched with each other.

Operations and effects of the fifth embodiment will be explained by using FIG. 18.

When unsealing the box, the adhesive tape 8*g* facing the slit 20*g* of one of the outer flaps is pushed by a nail to form a crack from the cut 12*g* formed on the adhesive tape 8*g*. When the nail is moved in the H-direction along the mating portion 7*g* while the nail is pushed, the crack is extended from the slit along the mating portion 7*g* and the adhesive tape 8*g* between both edges of the mating portion is cut.

Then, the portion K surrounded by the slit 20*g* shown in FIG. 18 is pushed into the box by a finger. Because of this, the force is applied to the cut 12*g* at a portion of the slit 20*g* formed between the outer flaps 4*g* and 3*g* and applied to the cut 12*g* of the adhesive tape 8*g* at a portion peeled off from the outer flaps. Thus, a crack is formed on the adhesive tape 8*g* in the F-G direction crossing the mating portion.

When the finger is entered from the mating portion 7*g* which is cut and an outer flap 3*g* is lifted up, the crack of the mating portion 7*g* is connected with the crack of the F-G direction and extended in the G-direction. Thus, the adhesive tape 8*g* between the outer flap 3*g* and the end face plate 2*g* is cut while a part of the adhesive tape is peeled off.

When the outer flap 4*g*, which is the other of the outer flaps, is lifted up, the crack in the F-direction is extended to cut the adhesive tape 8*g* between the outer flap 4*g* and the end face plate 2*g*. Thus, the box can be unsealed.

As the effect of the fifth embodiment, the cut 12*g* to function as a trigger to unseal the adhesive tape 8*g* can be easily formed because of the slit 20*g*. In addition, the crack in the F-G direction can be easily formed by pushing the portion K surrounded by the slit 20*g*. Thus the box can be easily unsealed.

Note that the shape of the slit 20*g* can be formed in an arc shape instead of a linear shape. In addition, the slit 20*g* can be formed orthogonal to the mating portion 7*g*.

The first variation example of the fifth embodiment will be explained by using FIG. 19. In first variation example of the fifth embodiment, different from the slit 20*g* of the fifth embodiment shown in FIG. 18, the slit is not open to the edge of the mating portion side of the outer flaps.

Figure 19:
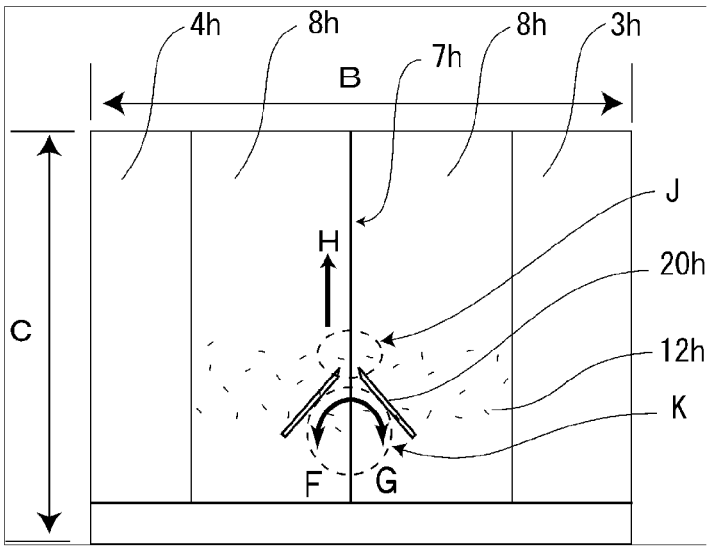
FIG. 19 is a plan view showing a part indicated by C-B concerning the first variation example of the fifth embodiment.

FIG. 19 is a plan view showing a part indicated by C-B in FIG. 17. A slit 20*h* shown in FIG. 19 is formed in a truncated chevron shape when viewed from an end face plate 2*h* side. A width of the slit 20*h* is 2 mm, and a length of the slit 20*h* is 11 mm. The slit is obliquely crossed with a mating portion 7*h* at an angle of plus/minus 45° from a part separate 2 mm from the edge of the end face plate. A cut 12*h* of the first variation example of the fifth embodiment shown in FIG. 19 is formed on an adhesive tape 8*h* at a surrounding area of the slit and separate 10 mm or more from the edge of the end face plate side of the outer flaps.

Operations and effects of the first variation example of the fifth embodiment will be explained by using FIG. 19. The method of unsealing the box, as an operation, is same as the second embodiment.

As the effect of the first variation example of the fifth embodiment, since the slit 20*h* is formed to be independent from the mating portion 7*h*, the crack is not extended to the mating portion 7*h* even when the crack is formed by an unintentional force. Thus, there is less possibility that the box is unintentionally unsealed when compared to the third embodiment. Other effects are same as the third embodiment.

Note that the perforation can be formed between the slit 20*h* and the mating portion 7*h* of the first variation example of the fifth embodiment as long as the outer flaps can be broken when the force is applied.

Sixth Embodiment

A tool and a method of forming a cut for facilitating unsealing a box of the sixth embodiment will be explained with reference to FIG. 20.

FIG. 20 is a perspective view showing a state of using the tool of the sixth embodiment. As shown in FIG. 20, the tool for facilitating unsealing the box is formed by sequentially combining a guide roller 22, a roller 21 and a roller 14. The roller 21 has a width of 10 mm and does not have needles. The roller 14 has a width of 40 mm and has needles. In the sixth embodiment, these rollers are integrally rotated.

In the present embodiment, the roller 14 functions as a roller having a protrusion on a cylindrical surface to form a cut on the adhesive tape. In addition, the guide roller 22 makes the roller 14 pass thorough the adhesive tape at a portion facing a part of the mating portion between the outer flaps and make the roller 14 rotate in a direction approximately orthogonal to a longitudinal direction of the mating portion, the part being located at an arbitrary distance from the end face plate.

Operations and effects of the sixth embodiment will be explained.

When the guide roller 22 of the sixth embodiment is rotated while the guide roller is in contact with an edge of an end face plate 2*n* side of the outer flaps of the box, a cut can be formed in a direction approximately orthogonal to a longitudinal direction of the mating portion.

In the sixth embodiment, the cut is not formed on the adhesive tape 8*n* at a portion within 10 mm from the edge of the end face plate side of each of the outer flaps. A cut 12*n* is formed on the adhesive tape facing a clearance P and a clearance R in FIG. 20. The clearance P is formed in parallel with the mating portion. The clearance R is formed in a sectorial shape.

Accordingly, same as the second embodiment, even when the force is applied to an outer flap 3*n*, there is little possibility that the box is unintentionally unsealed.

When unsealing the box, the force is applied by a nail to the clearance P paralleled with the mating portion to form a crack from the cut. Thus, the box is unsealed same as the third embodiment.

As explained above, when the roller tool of the six embodiment is used orthogonal to the longitudinal direction of the mating portion, the cut can be formed only at an arbitrary part of the mating portion near the end face plate. Accordingly, there is little possibility that the box is unsealed by an unintentional force, although a method for facilitating unsealing the sealed box can be provided.

Seventh Embodiment

A device for facilitating unsealing a box of the seventh embodiment will be explained with reference to FIG. 21.

FIG. 21 is a perspective view showing a state of using the device of the seventh embodiment. The device shown in FIG. 21 is a device for forming the cut 12 to function as a trigger to unseal the box on the adhesive tape 8 at a portion facing the indicator 13 shown as arrow marks formed on an arbitrarily part of the mating portion 7 of the box sealed by the adhesive tape 8 as shown in FIG. 2.

The device shown in FIG. 22 is formed by a roller 14 having a lot of needles on an cylindrical surface to form the cut 12 on the adhesive tape 8, a supporting body 16 to support the roller 14 so that the roller 14 can be moved in the mating portion direction (E-E' direction) of the box, and a belt conveyer 18 to move the sealed box in a direction orthogonal to the mating portion 7 so that the roller 14 is rotated on the sealed box.

In the present embodiment, the roller 14 functions as a cut-forming device that forms a cut on the adhesive tape to function as a trigger to unseal the box. In addition, the supporting body 16 functions as a first moving means that moves at least one of the mating portion of the box and the cut-forming device in a longitudinal direction of the mating portion. Furthermore, the belt conveyer 18 functions as a second moving means that moves at least one of the mating portion of the box and the cut-forming device in a direction approximately orthogonal to a longitudinal direction of the mating portion.

Since the roller 14 is supported by the supporting body 16 via an arm 15 having rotation shafts 17 on both ends, the roller 14 can be freely rotated and a rotation direction of the roller is a direction orthogonal to the mating portion when viewed from the above. In addition, the arm 15 can be freely moved in a direction (D-D' direction) approximately orthogonal to the mating portion 7.

Note that only a part of a belt 18 of the belt conveyer is shown in FIG. 22.

Operations and effects of the seventh embodiment will be explained by using FIG. 21.

As shown in FIG. 21, the box is placed on the center of the belt conveyer 18 so that the box is moved in a direction (D-D' direction) approximately orthogonal to the mating portion 7. The roller 14 is located to pass on the arrow marks 13 preliminary printed when the supporting body is moved in the E-E' direction. When the box is moved and the roller 14 is moved on the outer flap 4 located on the upper surface of the box, the needles formed on the cylindrical surface of the roller form the cut 12 on the box and the adhesive tape 8 while the roller is rolled (rotated) in a direction approximately orthogonal to the mating portion 7.

FIG. 3 shows the part A-B of the box on which the cut 12 is formed by the device shown in FIG. 21. As shown in FIG. 3, by using the device shown in FIG. 21, the cut 12 can be easily formed on the adhesive tape only at a portion passing the arrow marks 13 preliminary printed, the portion being extended in a direction approximately orthogonal to the mating portion 7.

Effects of the seventh embodiment is same as the sixth embodiment.

Note that the device or the tool to form the cut to function as a trigger to unseal the box can be a cutting device using a laser light, for example, without limited to the device and tool disclosed in the embodiments. As for the mechanism of moving the device or the tool in the direction approximately orthogonal to the longitudinal direction of the mating portion of the box, the box can be moved because the purpose can be achieved by the relative movement.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A box, wherein a mating portion is formed by facing edge portions of a pair of outer flaps of the box to each other, the box is sealed by fixing the mating portion, a neighboring part of the mating portion and an end face plate of the box using an adhesive tape made of a film as a base material, one of a cutout, a perforation or a slit showing a forming position of a cut to function as a trigger to unseal the box is formed on the box, and the cut is formed on the adhesive tape only at a portion facing to or neighboring to a part of the mating portion indicated as the forming position but not on an entire portion of the mating portion.

2. A box, wherein a mating portion is formed by facing edge portions of a pair of outer flaps of the box to each other, the box is sealed by fixing the mating portion, a neighboring part of the mating portion and an end face plate of the box using an adhesive tape made of a film as a base material, a clearance is formed on the mating portion at a range within 30 mm from an edge of the end face plate, at least one of the outer flaps is cut partly at the edge portions forming the mating portion so that a width of the clearance is within 5 mm to 25 mm and a length of the clearance is equal to or less than two thirds (⅔) of a short-side length of the adhesive tape, the width being measured orthogonal to a longitudinal direction of the mating portion, and a cut to function as a trigger to unseal the box is formed on the adhesive tape at a portion facing to the clearance and a surrounding area of the clearance.

3. A box, wherein a mating portion is formed by facing edge portions of a pair of outer flaps of the box to each other, the box is sealed by fixing the mating portion, a neighboring part of the mating portion and an end face plate of the box using an adhesive tape made of a film as a base material, a perforation or a slit orthogonal to or oblique to the longitudinal direction of the mating portion is formed on at least one of the outer flaps, the slit having a width of 5 mm or less, the perforation or the slit is formed at a range within 40 mm in a longitudinal direction of the mating portion from an edge of the end face plate, the perforation or the slit is formed at a range within 25 mm in a direction orthogonal to the longitudinal direction from the edge portion of the mating portion side of the outer fraps, the perforation or the slit is formed at a range within equal to or less than two thirds (⅔) of a short-side length of the adhesive tape in a direction orthogonal to the longitudinal direction from the edge portion of the outer fraps, a part of the outer flaps is pushed inside the box when the perforation or the slit is pushed, and a cut to function as a trigger to unseal the box is formed on the adhesive tape at a portion facing the perforation or the slit and a surrounding area of the perforation or the slit.

* * * * *